United States Patent [19]

Reed

[11] 4,391,324

[45] Jul. 5, 1983

[54] GEOTHERMAL WELL HEAD AND ACTUATOR ASSEMBLY

[75] Inventor: Lehman T. Reed, Bakersfield, Calif.

[73] Assignee: Midway Fishing Tool Co., Long Beach, Calif.

[21] Appl. No.: 291,377

[22] Filed: Aug. 10, 1981

[51] Int. Cl.[3] ..... E21B 37/04

[52] U.S. Cl. ..... 166/70; 166/72; 166/80; 166/86; 166/113; 166/170; 166/177

[58] Field of Search ..... 166/70, 72, 82, 83, 166/85, 86, 87, 64, 67, 170, 173, 174, 175, 255, 304

[56] References Cited

U.S. PATENT DOCUMENTS

| | | | |
|---|---|---|---|
| 2,486,308 | 10/1949 | McCray et al. | 166/86 |
| 2,678,696 | 5/1954 | Crake | 166/170 |
| 2,788,073 | 4/1957 | Brown | 166/72 |
| 3,166,345 | 1/1965 | Pinkard | 166/86 |
| 3,976,130 | 8/1976 | Chambless et al. | 166/173 |

*Primary Examiner*—William F. Pate, III
*Assistant Examiner*—William P. Neuder
*Attorney, Agent, or Firm*—William C. Babcock

[57] ABSTRACT

A valve supporting tubular assembly capable of being mounted on a geothermal well head, with the tubular assembly of such structure that an internal plug that supports resilient packers and has circumferentially extending teeth defined thereon may be removably locked in a first position to seal the interior of the tubular assembly above the outlets to the valves, the plug may also be moved longitudinally in the tubular assembly to scrape solids deposited on the interior surface thereof by geothermal fluids, and the plug may also be moved to a second position to pack off the interior of the tubular assembly below the valve outlets to permit the valves to be moved or maintenance work performed thereon without shutting down the geothermal well. In addition, the plug is provided with means to equalize the pressure above and below the plug in the tubular assembly to permit the plug and components situated thereabove to be removed from the tubular assembly.

A gate valve is situated above the valve supporting assembly and is normally open, with the gate valve supporting a hydraulic cylinder that serves to longitudinally move an actuator connected to the plug. Visual means are provided to indicate the position of the plug in the valve supporting assembly. The gate valve defines a confined space above the valve member when the latter is in a closed position in which the plug may be disposed. With the gate valve member in a closed position, the plug, actuator and hydraulic cylinder may be removed from the valve supporting tubular assembly for maintenance purposes without shutting down the well.

8 Claims, 16 Drawing Figures

FIG. 9
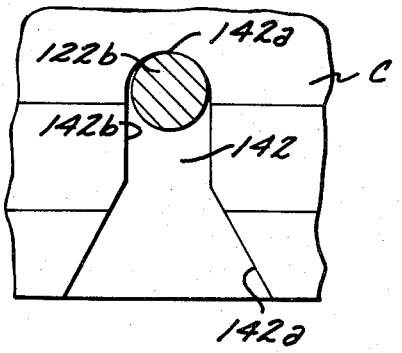
FIG. 10
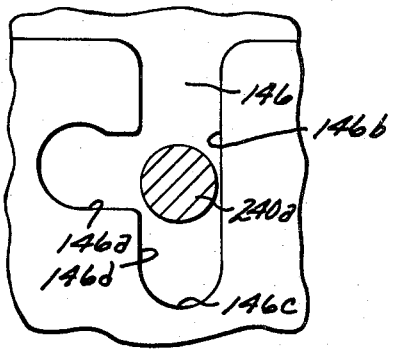
FIG. 11
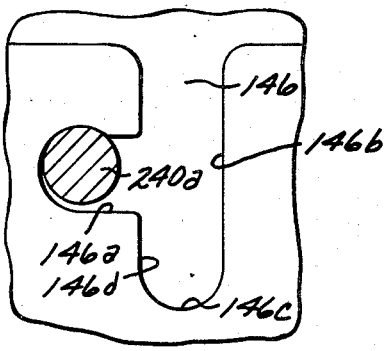
FIG. 12
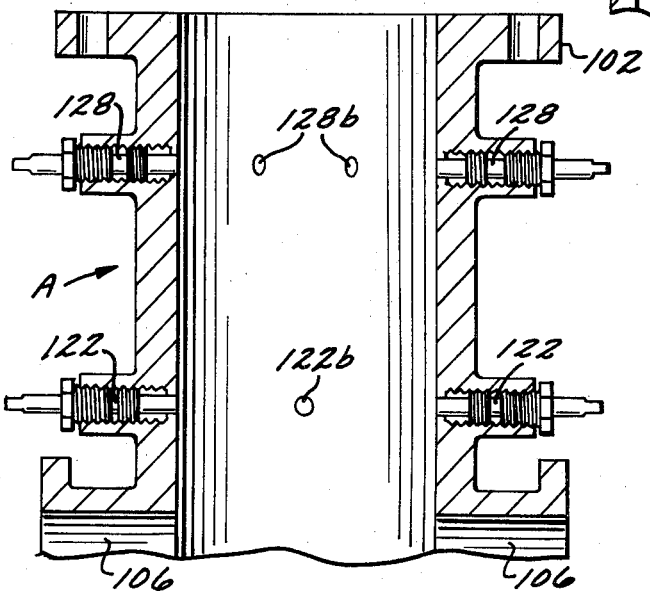
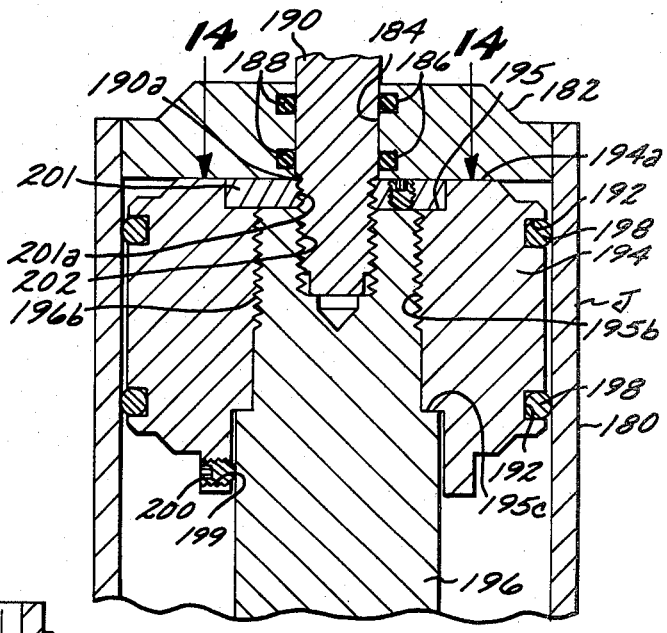
FIG. 13
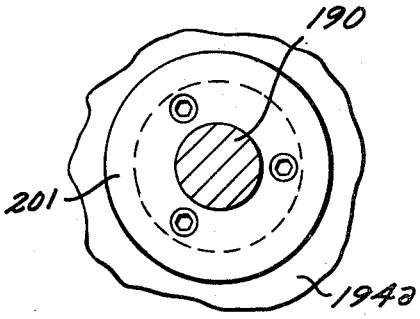
FIG. 14

GEOTHERMAL WELL HEAD AND ACTUATOR ASSEMBLY

REFERENCE TO RELATED APPLICATION

Application Ser. No. 203,407 filed in the U.S. Patent Office Nov. 11, 1980 by applicant and entitled "Geothermal Well Head".

DESCRIPTION OF THE PRIOR ART

In the production of fluid from a geothermal well certain operational difficulties are encountered that are not present in producing oil and gas from a well. Due to variations in temperature, the casing in a geothermal well tends to expand and contract longitudinally, and if the casing is rigidly secured to the valved assembly at the well head substantial damage may be done to the assembly due to this variation in length of the casing.

In my prior application, Ser. No. 203,407 above identified, a well head assembly is disclosed and claimed that allows such variation in length to the casing without damaging the assembly.

Also, in the production of fluid from a geothermal well, the well head assembly and valves supported therefrom have hard mineral layers deposited on the interior thereof that not only restricts the flow of fluid therethrough but may render the valves inoperative.

A major object of the present invention is to provide a valve supporting assembly for mounting on a geothermal well head in which solid mineral deposits that accumulate in the interior thereof may be removed therefrom without shutting down the well, and also permitting the valves supported from the assembly to be removed therefrom, or maintenance work performed on the valves while they remain in place on the assembly without shutting down the well.

Another object of the invention is to supply a vertically disposed tubular valve supporting assembly for mounting on a geothermal well head, with the assembly including a longitudinally movable plug that may be removably locked in a first sealing position above the outlets for the valves, may be moved downwardly in the assembly for teeth on the plug to scrape hard deposited material from the interior surface thereof, may be moved downwardly in the interior of the assembly to a second position below the outlets to the valves where it packs off the interior of the assembly to permit maintenance work to be performed on the valves, with all of the above described functions capable of being performed without shutting down the well. A further object of the invention is to supply a tubular valve supporting assembly in which the plug therein includes means to equalize the pressure above and below the plug to permit the plug and components thereabove to be removed from the assembly.

Another object of the present invention is to provide a valve supporting assembly that is particularly adapted for use with the well head of my previous application Ser. No. 203,407 that allows longitudinal expansion and contraction of the casing extending to the geothermal zone relative to the well head without damage to the latter.

A still further object of the invention is to supply a valve supporting assembly that includes a normally open gate valve that supports a hydraulic cylinder that powers an actuator to move the plug longitudinally in the assembly, with the plug capable of being moved above the valve member when the latter is closed, and the plug, actuator and hydraulic cylinder then capable of being removed from the assembly for maintenance purposes without shutting down the geothermal well.

SUMMARY OF THE INVENTION

The valve supporting assembly of the present invention, as may best be seen in FIGS. 1 and 2, is illustrated as mounted on a spool assembly secured to the upper end portion of a casing assembly, which spool assembly and casing assembly are disclosed and claimed in my prior application Ser. No. 203,407. The casing assembly includes a surface string of casing. The valve supporting assembly is defined by a vertically disposed tubular body that has tubular valve supporting bosses projecting outwardly therefrom intermediate the upper and lower ends thereof.

A plug is longitudinally movable within the tubular body, with the plug having packers on the upper end portion, and teeth on the lower portion for removing scale from the interior of the tubular body when it is moved downwardly therein. Two sets of longitudinally spaced pins are mounted for lateral movement in the tubular body, and when both sets are moved inwardly the plug is removably locked therebetween in a first position above the valve supporting bosses, and the plug sealing the upper interior of the tubular body.

A pressurized fluid actuator assembly is removably secured to the upper end of a gate valve. The lower end of the gate valve is secured to the upper end of the tubular body. The valve member of the gate valve is normally in an open position, with the actuator extending downwardly through the gate valve to move the plug. When the lowermost set of pins is moved outwardly, the actuator assembly may move the plug downwardly in the tubular body to remove scale therefrom. When the plug is moved downwardly to a second position below the tubular valve supporting bosses, the interior of the tubular body below the bosses is packed off, and the valves may be removed therefrom or maintenance work performed on the valves without shutting down the well. The actuator is of such structure that it visually indicates the position of the plug in the tubular member.

After the valve maintenance work and scraping has been completed the actuator is moved upwardly to raise the plug to a position where the upper ends of slots in the lower exterior side portion thereof are above the lowermost set of pins. The lowermost set of pins are now moved inwardly to engage the slots. The actuator now applies pressure to the packing on the upper end of the plug to compress the same with a pressure ring, and to the extent that the upper set of pins may be moved inwardly to engage the pressure ring. The plug is now removably locked in the first sealing position in the tubular body, and the actuator may be removed therefrom.

The plug includes valve means that are normally closed but may be opened by downward movement of the actuator to permit equalization of gas pressure below and above the plug in the tubular assembly. After such equalization the plug and actuator may be moved upwardly in the gate valve above the valve member.

The transversely movable valve member of the gate valve is now moved to a closed position, and the plug, actuator and hydraulic cylinder may be removed from the invention to have maintenance work performed thereon, and without shutting down the well.

BRIEF DESCRIPTION OF THE DRAWINGS

FIG. 9 is a fragmentary side elevational view of one of a number of tapered upwardly extending recesses in the plug assembly that is oriented to have one of the lower most threaded pins moved into engagement therewith and taken on the line 9—9 of FIG. 8;

FIG. 10 is a fragmentary side elevational view of the position one end of the engageable member of the actuator will occupy when the valve on the plug is moved to the open position and taken on the line 10—10 of FIG. 8;

FIG. 11 is a side elevational view of the position one end of the engageable member on the actuator will occupy in one of a pair of slots on the plug assembly when the latter is to be moved upwardly in the valve supporting assembly and removed therefrom;

FIG. 12 is a fragmentary longitudinal cross sectional view of the valve supporting assembly the plug assembly, actuator and pressurized air cylinder is removed therefrom;

FIG. 13 is a vertical cross sectional view of a portion of the hydraulic cylinder, piston, actuator, and visible portion of the actuator that inidicates not only the depth of the plug assembly in the tubular valve supporting assembly but the rotational position thereof;

FIG. 14 is a fragmentary top plan view of the piston taken on the line 14—14 of FIG. 13;

DESCRIPTION OF THE PREFERRED EMBODIMENT

The geothermal well head and actuator assembly invention A as best seen in FIGS. 1, 3, 15 and 16 is illustrated as mounted on a spool B that is secured to a casing assembly C. The casing assembly C extends to a geothermal zone. The invention A is capable of having caked foreign material removed from the interior thereof without shutting down the well. A toothed scraping and sealing plug may be so disposed in the invention A that fluid control valves may be removed from the invention A for repair or replacement without shutting down the well. Also, the toothed scraping and sealing plug, actuator and hydraulic cylinder may be removed from the invention without shutting down the well.

Figure 2:
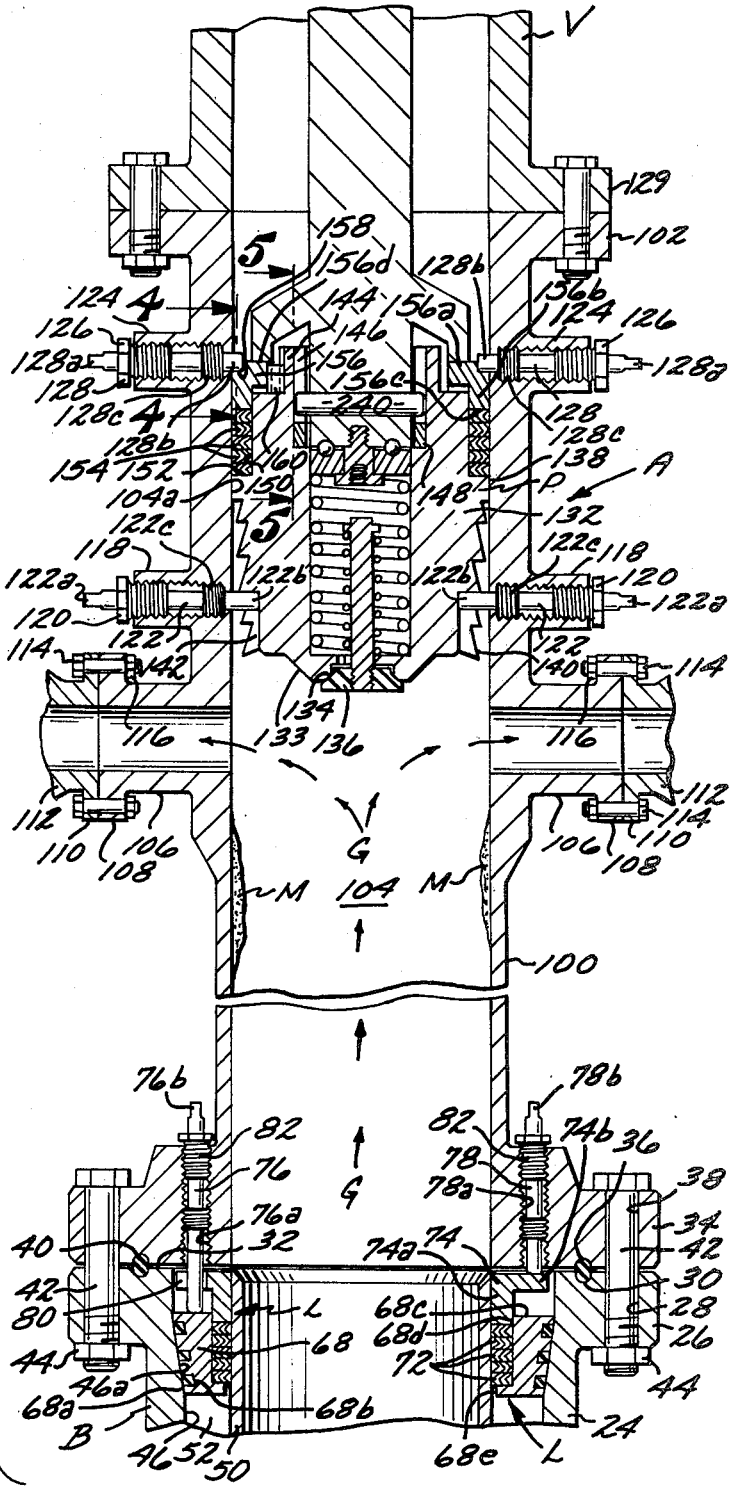
FIG. 2 is a longitudinal cross sectional view of the invention taken on the line 2—2 of FIG. 1, with the plug in a first position that allows fluid from the geothermal well to discharge through the valve supporting tubular bosses.

The spool assembly B includes a cylindrical shell 24 that has a first flange 26 mounted on the upper end thereof and extending outwardly therefrom. The first flange 26 has a number of circumferentially spaced bolt holes 28 therein, and a circular groove 30 is formed in the upper face 32 of the first flange 26 as shown in FIG. 2. A second flange 34 is in abutting contact with the first flange 26 as shown in FIG. 2, with the second flange having a groove 36 and bolt holes 38 therein that are aligned with the groove and bolt holes in the first flange. A resilient ring 40 is disposed within the grooves 30 and 36. Bolts 42 extend downwardly through the bolt holes 28 and 38, and with the lower ends of the bolts being engaged by nuts 44.

The cylindrical shell 24 has an interior surface 46, with an upper portion **46*a* thereof tapering downwardly and inwardly as shown in FIG. 2. A tubular member 50 is provided that has an external diameter substantially less than the diameter of the interior surface 46 of the shell 24, with the tubular member 50 having an upper end 50*a* that is adjacently disposed to the second flange 34. The tubular member 50 and the interior surface 46 of the shell 24 cooperate to define an annulus space 52 therebetween. The tubular member 50 is in communication with a string of production casing (not shown) that extends to the geothermal zone from which fluid is being produced. A seal assembly L is shown in FIG. 2, which assembly effects a seal between the interior surface of the spool B and the exterior surface of tubular member 50. The seal combination L includes a first rigid ring 68 that has an outer tapered face 68*a* that is substantially the same angulation as that of the tapered surface 46*a* of spool B. The tapered face 68*a* has a number of spaced recesses 68*b* extending inwardly therefrom in which first sealing rings 70 are disposed, with the first sealing rings extending outwardly from the recesses 68*b*** a sufficient distance as to be compressed when in contact with the surface 46*a*.

The first ring 68 includes a flat upper surface 68*c*, and interior cylindrical surface 68*d* that is radially spaced from the exterior surface of the tubular member 50, and a circular abutment 68*e* that extends inwardly. Second sealing rings 72 encircle the tubular member 50 as shown in FIG. 2, and are disposed in an annulus space defined by the lower circular abutment 68*e* and the cylindrical first surface 68*d*.

A second rigid ring 74 is mounted in the annulus space 52 above the first ring 68 as shown in FIG. 2. The second ring 74 is defined by a first vertically extending leg 74*a*, which leg has a lower end thereof in engagement with the uppermost one of the sealing rings 72. The first vertical leg 74*a* has a second horizontal leg 74*b* extending outwardly from the upper portion thereof as shown in FIG. 2, which second leg is situated within the annulus space 52.

The second flange 34 threadedly supports a number of externally threaded first elongate members 76 in tapped bores 76*a* and second elongate threaded members 78 in tapped bores 78*a* that are circumferentially spaced from one another, with the first members extending downwardly through bores 80 formed in the second leg 74*b* as shown in FIG. 2. By rotating the first member 76 they may be moved downwardly relative to the second flange 34, with the lower ends of the members being in contact with the upper surface 68*c* of the first ring 68, and moving the latter downwardly to force the first sealing ring 70 into pressure sealing contact with the surface 46*a*.

By rotating the second member 78 in an appropriate direction, lower ends thereof exert a downward force on the second horizontal leg 74*b*, to force the member 74 downwardly, and compress the second sealing rings 72 into sealing engagement with the exterior surface of the tubular member 50. From the above description, it will be seen that the first and second sealing rings 70 and 72 may be periodically subjected to increased force to maintain them in sealing contact with the tapered surface 46*a* and the external surface of the tubular member 50. The upper end portions of the first and second members 76 and 78 are of cylindrical shape and sealingly disposed in bushings 82 mounted in the upper portions of the tapped bores 76*a* and 78*a*. The upper extremities 76*b* and 78*b* of the first and second members 76 and 78 are of non-circular transverse cross section to permit the members to be rotated by a suitable hand tool (not shown).

In detail, it will be seen that the valves supporting geothermal well head assembly A includes a tubular member 100 that extends upwardly from the second flange 34 to terminate on the upper end in a third flange 102. The tubular member 100 as best seen in FIG. 2 includes an upwardly extending confined space 104 through which geothermal fluid G from the well on which the assembly A is mounted may flow upwardly when the plug assembly P is disposed as shown in FIG. 2. The tubular member 100 is illustrated in FIG. 2 as having a pair of oppositely disposed tubular bosses 106 extending outwardly therefrom that are in communication with the space 104.

The bosses 106 terminate on their outer ends in flanges 108 that are in abutting contact with flanges 110 that form a part of conventional valves 112 that are but partially shown in FIG. 2. Each pair of flanges 108 and 110 are removably secured to one another by bolts 114 and nuts 116 in a conventional manner. The valves 112 serve to control the flow of the geothermal fluid G from the assembly A.

In FIG. 2 it will be seen that the tubular member 100 has a lower set of circumferentially spaced, internally threaded, tubular bosses 118 projecting outwardly therefrom. Each of the lower tubular bosses 118 has a seal defining bushing 120 in threaded engagement therewith. Each one of the bushings 120 sealingly engages one of a lower set of elongate pins 122. Each of the pins 122 includes a wrench engageable outer end 122*a*, and inner end portion 122*b*, and an externally threaded intermediate portion 122*c* that threadedly engages the interior of one of the bosses 118 as shown in FIG. 2.

An upper set of circumferentially spaced internally threaded tubular bosses 124 also extends outwardly from the tubular member 100 as best seen in FIG. 2, with each of these bosses also including an upper seal defining bushing 126 that has threads formed on the interior thereof. An upper set of elongate pins 128 is provided, with each of these pins including a wrench engageable outer end 128*a* and inner end portion 128*b*, and an intermediately disposed externally threaded portion 128*c* that engages the interior of one of the upper bosses 124. In FIG. 2 it will be seen that the pins have been screwed inwardly in the upper and lower bosses 118 and 124 and are in removable engagement with the plug assembly P to removably support the same in a fixed position in the tubular member 100 above the pair of bosses 106 through which the geothermal fluid G may discharge.

The third flange 102 as may be seen in FIG. 2 is in abutting contact with the lower flange 129 on an elongate tubular body 131 of a gate valve V which body has an upper flange 133. The purpose of valve V will later be explained.

The details of the plug assembly P are best seen in FIG. 2, with the plug assembly including a rigid cylindrical body 132 that has a lower end surface 133 from which a tapered centered valve seat 134 extends upwardly. The valve seat 134 is normally sealingly engaged by a tapered valve member 136. The cylindrical body 132 includes a cylindrical sidewall 138 that snuggly and slidably engages the interior 104*a* of the tubular member 100 that defines the confined space 104. The plug body 132 below the sidewall 138 defines a number of circumferentially extending, longitudinally spaced teeth 140 of decreasing diameter that may be seen in FIG. 2. Each of the teeth 140 has a sharp circumferential edge that is adapted to scrape hard deposited mineral layers M from the interior surface 104*a* of the tubular member as the plug assembly is moved downwardly therein as will later be explained.

The cylindrical body 132 as best seen in FIGS. 2 and 9 has a number of circumferentially spaced slots 142 formed in the lower sidewall portion thereof. The slots 142 may be removably engaged by the inner portions 122*b* of the lower set of pins 122 as shown in FIG. 2. One of the slots 142 is provided for each of the lower pins 122.

Each of the slots 142 as shown in FIG. 9 includes a lower outwardly flared end portion 142*a*, and an upper portion 142*b* of uniformed width that terminates on the upper end in a top 142*c*. When the pin portions 122*b* are in engagement with the slots 142 as shown in FIG. 9, the plug assembly P cannot move downwardly in the confined space 104.

The plug body 132 has a tubular collar 144 extending upwardly therefrom which has a diametrically opposed pair of slots 146 defined therein which in detail are best seen in FIGS. 5, 6, 10 and 11. Each of the slots 146 includes a horizontal leg 146*a* and a vertical leg 146*b*, and the lower leg 146*d* terminating in a bottom 146*c* as shown in FIG. 10. A rigid ring 148 is mounted in a downwardly extending cavity 144 formed in the body 132 directly below the interior of the collar 144 which ring is identified by the numeral 148. A circumferentially extending recess 150 is formed in the upper portion of the plug 132 and terminated on the lower end in a circumferentially extending body shoulder 152. The recess 150 serves to support a number of resilient packers 154 that are stacked one above the other and encircle the plug body 132 as shown in FIG. 2.

Figure 4:
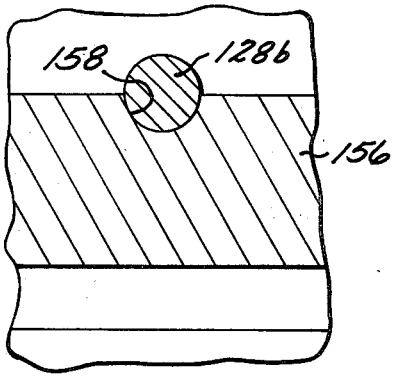
FIG. 4 is a fragmentary vertical cross sectional view of one of the uppermost threaded pins in engagement with a recess in the packer engaging ring that forms a part of the plug assembly and taken on the line 4—4 of FIG. 2.
Figure 5:
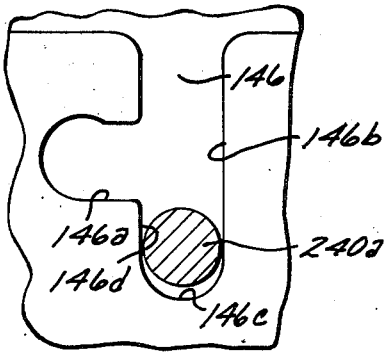
FIG. 5 is a fragmentary vertical cross sectional view of one end of a transverse engageable member of the actuator in engagement with the lowermost portion of one of a pair of vertical slots in the plug assembly and taken on the line 5—5 of FIG. 2.

In FIG. 2 it will be seen that a rigid pressure exerting ring 156 is provided that has an inverted L transverse cross section, which ring is defined by a horizontal leg 156*a* and a vertical leg 156*b*. The leg 156*b* terminates in a lower surface 156*c* that is in abutting contact with the uppermost one of the packers 154. The horizontal leg 156*a* has an upper surface 156*d* in which a number of circumferentially spaced semi-circular recesses 158 are defined as best seen in FIGS. 2 and 4, that may be removably engaged by the inner end portions 128*b* of the upper pins 128 when the pins 128 are screwed inwardly as shown in FIG. 2.

Figure 3:
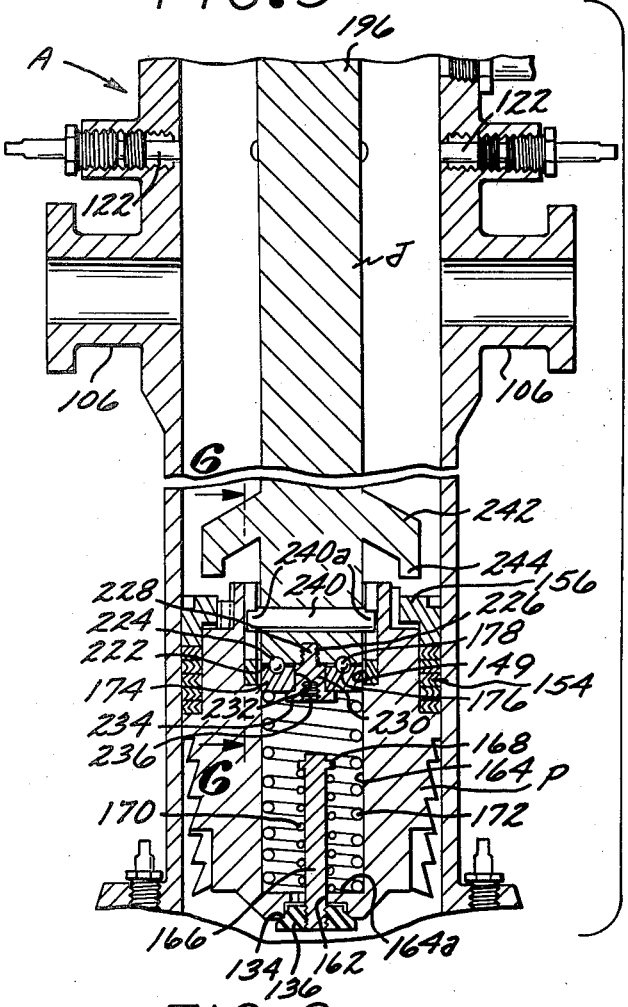
FIG. 3 is the same view as shown in FIG. 2 but with the threaded pins that maintain the plug in a first position having been retracted to permit the plug to be forced downwardly in the tubular valve supporting assembly to remove caked mineral deposits from the interior surface thereof.

The plug body 132 and the ring 156 are removably secured in non-rotatable engagement relative to one another by a key 160 that engages slots (not shown) in the body and ring. The valve seat 134 as best seen in FIG. 3 developed into a first upwardly extending bore 162 that developed into a second bore 164 of greater diameter that communicates with the cavity 149. The valve member 136 is secured to a valve stem 166 that is slidably mounted in bore 162. Valve stem 166 develops into an enlarged upper end portion 168. A first compressed helical spring 170 encircles the valve stem 168, with the upper end of the spring being in abutting contact with the enlarged upper end 168 and the lower end of the spring being in abutting contact with a body shoulder 164*a* defined at a junction of first and second bores 162 and 164.

A second helical spring 172 is also mounted in the second bore 164 and has the lower end in abutting contact with the body shoulder 164*a*, and the upper end being in pressure contact with the circular plate 174. Plate 174 on the upper surface thereof has a groove 176 defined therein in which a number of ball bearings 178 are disposed.

Figure 1:
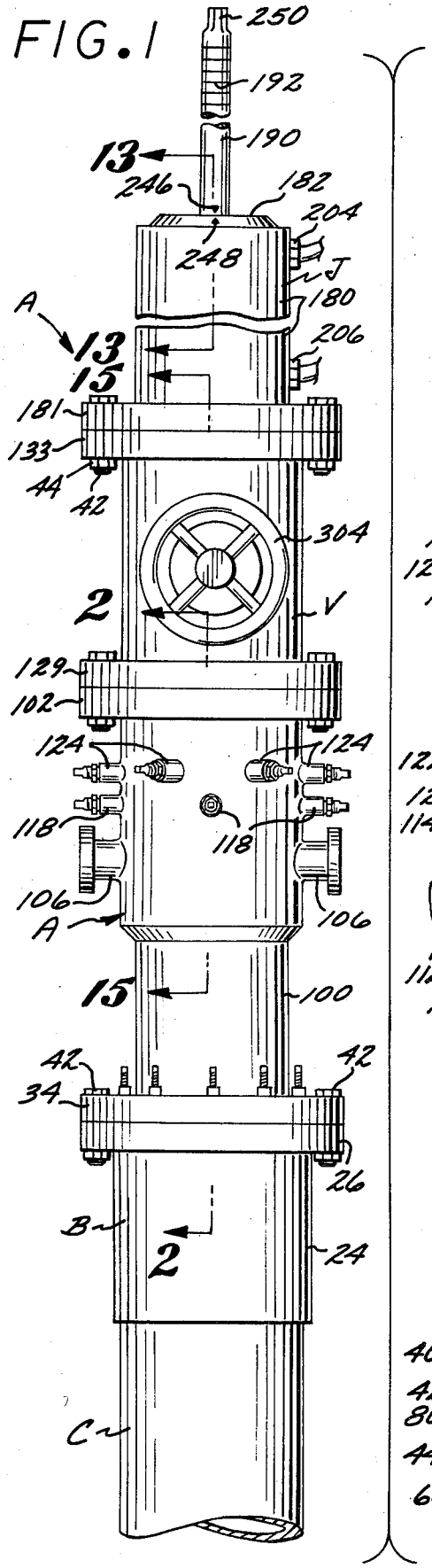
FIG. 1 is a side elevational view of the geothermal valve supporting assembly with a gate valve, visible portion of the actuator, and pressurized fluid cylinder supported there above.

The actuator J of the present invention includes a hydraulic cylinder 180 that extends upwardly from a fourth flange 181 that rests on the upper valve flange 133 as best seen in FIG. 1 and is removably secured thereto by bolts 42 and nuts 44 in a conventional manner. Cylinder 180 has a top 182 secured thereto in which a centered transverse bore 184 is defined. Bore 184 has one or more recesses 186 extending outwardly therefrom that serve to support resilient rings 188. A plug depth indicating rod 190 is slidably mounted in the bore 184 and extends upwardly above the top 182. The rod 190 as shown in FIG. 1 has graduations 192 thereon that indicate the depth at which the plug assembly P is disposed within the tubular member 100 when one of the graduations is horizontally aligned with the upper surface of top 182.

The actuator assembly J as may best be seen in FIG. 13 includes a piston 194 in cylinder 180 that has grooves 192 on the exterior surface thereof that support resilient sealing rings 198 that are in slidable contact with the interior surface of the hydraulic cylinder 180. The piston 194 has a top 194*a* in which a cavity 195 extends downwardly and develops into a tapped bore 195*b*, which bore on the lower portion thereof develops into a body shoulder 195*c*.

An actuator rod 196 extends upwardly through valve body 131 when valve V is open to engage the piston 194, which actuator rod has a body shoulder 195*c*, and also the actuator rod having threads 196*b* on the upper portion thereof that engage the threads 195*b* as best seen in FIG. 13. The piston 194 has a tapped bore 199 in the lower portion thereof in which a set screw 200 is disposed that bears against the actuator rod 196 to prevent the actuator rod rotating relative to the piston 194. The lower end of the position indicating rod 190 has external threads 190*a* formed thereon that engage a tapped bore 201*a* in a locking plate 201 that is disposed in the cavity 195, as well as the threads on the rod engaging a tapped cavity 202 that extends downwardly in the actuator rod 196.

In FIG. 1 it will be seen that a hydraulic fluid inlet tube 204 is provided in the upper portion of the cylinder 180 and a similar hydraulic fluid inlet 206 is in communication with the lower interior of the cylinder 180. When pressurized hydraulic fluid from a source (not shown) is discharged through one of the inlets and hydraulic fluid allowed to discharge through the other, the piston 194 is moved upwardly and downwardly in the air cylinder to longitudinally move the actuator rod 196 of the actuator assembly J for reasons that will later be explained.

The interior of fourth flange 181 has threads 210 formed on the interior thereof that are engaged by threads 212 formed on a hydraulic cylinder end plate 214 that has a centered transverse bore 216 therein in which the actuator rod 196 is slidably movable. Bore 216 has recesses 218 extending outwardly therefrom in which resilient sealing rings 220 are disposed that sealingly engage actuator rod 196.

Figure 8:
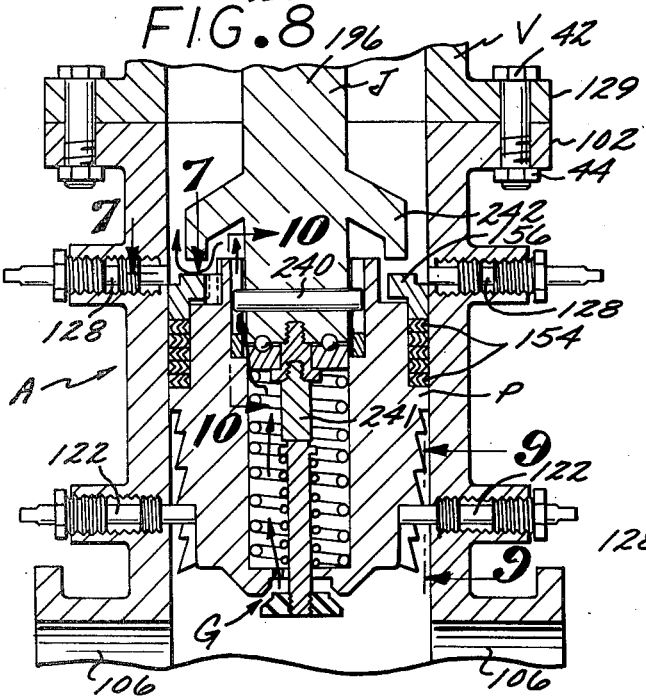
FIG. 8 is a vertical cross sectional view of the plug assembly that includes a normally closed valve, but a valve that may be opened by manipulation of the actuator to permit gas pressure to equalize in the tubular valve supporting assembly above and below the plug prior to the plug actuator, and air cylinder being removed from the tubular valve supporting assembly.
Figure 7:
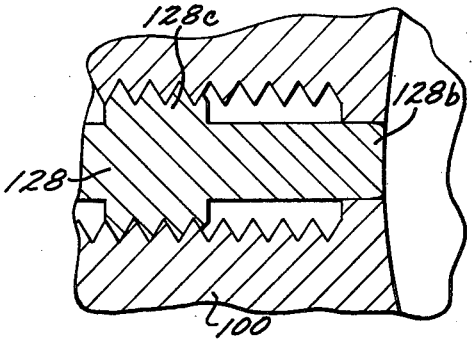
FIG. 7 is an enlarged longitudinal cross sectional view of one of the threaded pins taken on the line 7—7 of FIG. 8.

Actuator rod 196 has a flat lower end 222 best seen in FIG. 3 from which a semi-circular groove 224 extends upwardly and engages ball bearings 178. A tapped recess 226 extends upwardly from end 222 and is engaged by an externally threaded end 228 of a cylindrical rigid member 230 that extends through a transverse bore 232 in plate 174. Member has an enlarged head 234 on the lower end thereof that maintains plate 174 in rotatable engagement with actuator rod 196. A tapped bore 236 extends upwardly in member 230 that may be removably engaged by the upper threaded valve actuator pin 241 as shown in FIG. 8.

In FIGS. 2 and 3 it will be seen that the actuator rod 196 supports a transverse actuator pin 240 that has outwardly projecting portions 240*a* that are movable in the slots 146 shown in FIGS. 5, 6, 10 and 11. Actuator rod 196 above pin 240 has a circular member 242 extending outwardly therefrom that has a circular force exerting member 244 extending downwardly therefrom.

The visible portion of depth indicating rod 190 has a first mark 246 thereon as shown in FIG. 1 that when vertically aligned with a second mark 248 on the upper end of hydraulic cylinder 180 visually dicates that the plug P is so oriented in tubular member 100 that upper and lower pins 122 and 128 are radially aligned with recesses 158 and slots 142 shown in FIGS. 4 and 9. The upper end portion of rod 190 is formed with a non-circular end portion 250 to permit it to be rotated by a suitable power source (not shown).

When it is desired to remove foreign material M from the interior of the cylindrical member 100, which material is shown in FIG. 1, the pins 122 are rotated in a direction to move outwardly from disengagement with slots 142. Plug P is now free to move downwardly in tubular member 100. Pressurized fluid is now discharged into air cylinder J above piston 194 and the actuator rod 196 is moved downwardly together with plug P. The actuator pin portions 240*a* will be disposed in horizontal slot portions 146*a* as shown in FIG. 11 to prevent the packers 154 being radially expanded into pressure sealing contact with the interior surface of tubular member 100. As plug P is moved downwardly in tubular member 100 the teeth 140 scrape the foreign material M therefrom. End 250 may be rotated to rotate plug P if desired during the scraping operation.

When it is desired to remove the valves 112 for repair or replacement plug P is moved downwardly below the bosses 106 as shown in FIG. 3, with the plug sealing the interior of the tubular member 100 without killing the well.

Figure 6:
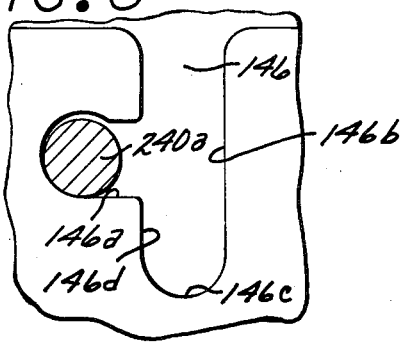
FIG. 6 is a fragmentary vertical cross sectional view of one end of a transverse engageable member on the actuator in engagement with an intermediate horizontal leg that forms a part of one of the pair of vertical slots in the plug assembly and taken on the line 6—6 of FIG. 3.

When it is desired to return the plug C to the sealing position shown in FIG. 2 hydraulic fluid is discharged in and out of cylinder 180. The actuator end portions 240*a* are in engagement with horizontal slot portions 146*a* as shown in FIG. 6. The piston 194 is moved upwardly until the depth indicating rod 190 shows that the slots 140 in the plug P are above the lower pins 122. Depth indicating rod 190 has a non-circular upper portion that permits rotation of the rod. The rod 190 is now rotated to concurrent rotate piston 194, actuator rod 196, and plug P to radially align lower pins 122 with slots 140 and upper pins 128 with recesses 158. Lower pin portions 240*a* are rotated out of horizontal slot portions 146*a* into slots 146. Actuator rod 196 is now caused to move downwardly for member 244 to pressure contact rigid ring 156. Rigid ring 156 moves downwardly and compresses packers 154 into sealing contact with the interior surface of tubular member 100. Upper pins 128 are now rotated to move inwardly to engage recesses 158 in ring 156 as shown in FIGS. 2 and 4.

When the plug P is disposed as shown in FIG. 8 and it is desired to equalize the gas pressure above and below the plug P, the actuator rod is rotated to dispose actuator pin end portions in slots 146 and then moved downwardly therein. Member 240 shown in FIG. 8 will pressure contact the upper end of member 166 and move the latter downwardly to separate valve member 136 from seat 134 with pressurized gas and fluid flowing upwardly through the interior portion of plug P to the space thereabove.

The above precedure is desirable when the plug P and actuator assembly are to be separated from the tubular member 100 without shutting down the well.

Figure 15:
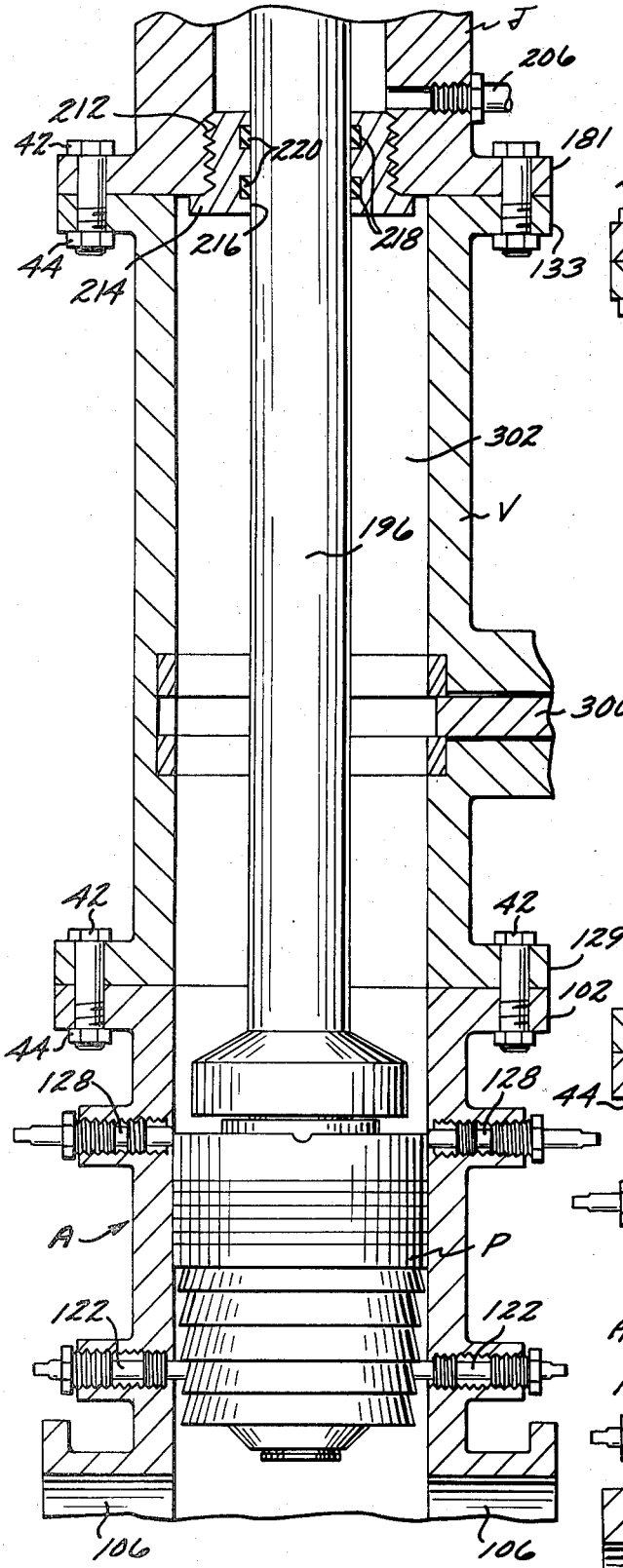
FIG. 15 is a longitudinal cross sectional view of the valve supporting assembly and gate valve in the open position, with the plug removably locked in a first position by the upper and lower pins, and the actuator extending upwardly through the open gate valve.
Figure 16:
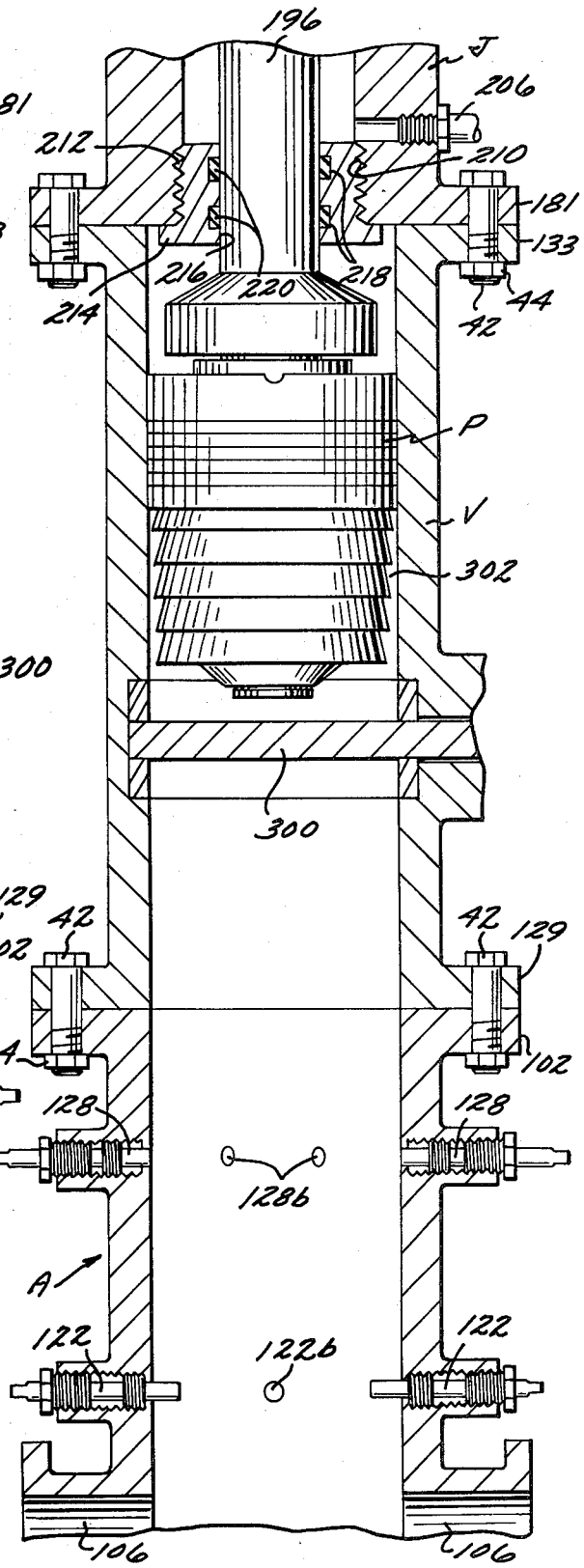
FIG. 16 is the same view as shown in FIG. 15 but with the upper and lower pins disengaged from the plug, with the plug disposed above the gate valve member which is in a closed position, and the plug, actuator and hydraulic cylinder now capable of being removed from the tubular valve supporting body for maintenance purposes without shutting down the well.

The gate valve V has a transversely movable valve member 300 which in FIG. 15 is shown in the open position. A space 302 is defined in valve body 131 to accomodate the plug P. To remove the plug P for maintenance without shutting down the well, the plug is moved upwardly into the space 302, and valve member 300 moved to the left to the closed position shown in FIG. 16. The actuator assembly and hydraulic cylinder 180 may now be separated from gate valve V for maintenance or repair. The hydraulic cylinder 180 and actuator assembly are returned to the position shown in FIG. 1 by reversing the above procedure. Movement of the gate valve member 300 may be achieved by rotating a wheel 304 shown in FIG. 1.

The use and operation of the invention has been explained previously in detail and need not be repeated.

What is claimed is:

1. In combination with a geothermal well that has a string of casing that extends to a producing zone, said string of casing having an upper end, a device in communication with said upper end that controls the flow of geothermal fluid from said well, said device capable of having solid deposited material scraped from the interior surface thereof without shutting down said well, said device including:

a. a first assembly that includes an elongate tubular body that has upper and lower ends and is vertically disposed; first means that effect communication between said lower end of said tubular body and said upper end of said casing; upper and lower longitudinally spaced sets of pins supported on said tubular member that may be moved inwardly and outwardly relative thereto, each of said upper and lower pins having an inner end portion; at least one tubular boss that projects outwardly from said tubular body below said lower set of pins; and a valve in communication with said tubular boss for controlling the flow of geothermal fluid therefrom;

b. a gate valve that includes an elongate valve body that when vertically disposed has upper and lower ends, a transversely movable valve member, and said valve body having a longitudinally extending interior passage of at least as great transverse cross section as that of the interior of said tubular body;

c. second means for securing said lower end of said gate valve to said upper end of said tubular body;

d. a hydraulic cylinder assembly that includes a hydraulic cylinder that has a top and bottom; a piston slidably mounted in said cylinder; third means for discharging hydraulic fluid under pressure into and out of said cylinder to move said piston upwardly and downwardly therein; fourth means for removably securing said bottom of said hydraulic cylinder to said upper end of said gate valve; a graduated rod that extends upwardly through a seal defining opening in said top of said hydraulic cylinder; an actuating member that extends downwardly from said piston through a seal defining opening in said bottom of said hydraulic cylinder, downwardly through said gate valve body when said valve member is in an outwardly disposed position; a transverse pin on a lower portion of said actuating member, which pin has projecting end portions; and a force exerting member supported from said actuating member above said pin;

e. a plug assembly that includes a rigid body that has a cylindrical sidewall, a top surface, and a bottom surface that may be disposed in said tubular body; a circular recess in said sidewall that extends downwardly from said top surface to terminate in a circular body shoulder; resilient packing means in said recess; a cavity that extends downwardly from said top surface into rigid body to terminate in a bottom, said cavity having a pair of vertical grooves extending outwardly from the portion thereof adjacent said top, said pair of grooves that extend from intermediate positions of said vertical grooves, said vertical and horizontal grooves being removably engageable by said projecting end portions of said transverse pin; a plurality of slots that extend upwardly in said cylindrical sidewall from said bottom surface that may be radially aligned with said lower pins; a rigid force receiving ring that has a downwardly extending first leg that abuts against said packing means and an inwardly extending second leg that may be contacted by said force exerting ring, said force receiving ring having a pluraliry of circumferentially spaced grooves therein that may be engaged by said upper pins when said packing means is compressed by downward movement of said first leg of said force receiving ring; spring means in said cavity that exert an upward force on said actuator member that tends to maintain said end portions of said transverse pin above said horizontal slots when said end portions are in said vertical grooves; and fifth means that slidably connect said force receiving ring to said body of said plug assembly, with said force receiving ring only compressing said packing means into sealing contact with the interior surface of said tubular body of said first assembly until after said transverse pin end portions have moved downwardly in said vertical grooves below said horizontal grooves; with said graduated rod visually indicating the position of said plug assembly in said tubular body;

f. first and second insignias on said graduated rod and said top of said hydraulic cylinder which when in a predetermined position relative to one another indicate said slots and grooves are radially with said upper and lower pins; and g. sixth means for rotating said graduated rod together with said piston and actuating member, with said plug assembly being in a sealing position in said tubular body when said lower pins have said inner end portions in engagement with said slots and said inner end portions of said upper pins engage said grooves; with said plug scraping said foreign material from the interior of said tubular body of said first assembly when said graduated rod, piston and actuating member are rotated to dispose said transverse pin end portions in said horizontal slots, said lower pins are moved outwardly from disengagement from said slots, and said piston is caused to move said actuating member and plug assembly downwardly in said tubular member for said teeth to scrape said foreign material therefrom; said plug assembly being returned to a sealing position when said first and second insignia are aligned, said plug is moved upwardly in said tubular body to a position where said slots are above said lower pins, said lower pins are moved inwardly, said plug assembly is moved downwardly for said inner end portions of said pins to engage said slots, said actuating member, piston and graduated rod are rotated to dispose said transverse pin end portions in said vertical grooves, said actuating member is moved downwardly to move said force exerting ring and force receiving ring downwardly until said grooves are below said upper pins, said upper pins are moved inwardly to engage said grooves to maintain said packing means in compressed sealing contact with the interior surface of said tubular body of said first assembly; and said plug assembly, actuator rod and hydraulic cylinder assembly capable of being removed from said first assembly by rotating said actuator rod to dispose said inner end portions of said transverse pins in said horizontal slots, moving said upper pins outwardly from engagement with said grooves, moving said plug assembly upwardly in said elongate body of said gate valve above said transversely movable valve member, and moving said valve member to an inwardly disposed position whereupon said hydraulic cylinder assembly, actuator member and plug assembly may be removed from said gate valves without shutting down said well.

2. In combination with a geothermal well that has a string of casing that extends to a producing zone, said string of casing having an upper end, a device in communication with said upper end that controls the flow of geothermal fluid from said well, said device capable of having solid deposited material scraped from the interior surface thereof without shutting down said well, said device including:

a. a vertically disposed first assembly that includes an elongate tubular body that has upper and lower ends; at least one tubular boss that extends outwardly from an intermediate position on said tubular body; valve means in communication with said boss for controlling the flow of geothermal fluid from said well; lower radially movable means on said tubular body above said tubular boss; and upper radially movable means on said tubular body a substantial distance above said lower radially movable means, and first means that effect communication between said lower end of said tubular body and said upper end of said casing;

b. a plug assembly that includes a rigid generally cylindrical body that has a top and bottom surface and is slidably movable in said tubular body, said cylindrical body having an outer recess that extends downwardly from said top surface to terminate in a ring shaped body shoulder, a cavity that extends downwardly in said cylindrical body from said top surface to terminate in a bottom, a pair of oppositely disposed vertical grooves in said cylindrical body in communication with said cavity said pair of grooves having a pair of lower ends, a pair of horizontal grooves in said body in communication with said cavity and with said vertical grooves at intermediate positions thereon, a plurality of longitudinally spaced teeth means on the external surface of said cylindrical body adjacent said bottom surface for scraping said foreign material from said tubular body when said cylindrical body is moved downwardly in the latter; resilient packing means in said recess that slidably engage the interior surface of said tubular member when cylindrical body is moved downwardly therein; a rigid force receiving ring that has an upper surface and which ring includes a downwardly extending leg that rests on said resilient packing means, said force receiving ring when moved downwardly relative to said cylindrical body compressing said resilient packing means and radially expanding the same into sealing contact with the interior of said tubular body, said plug assembly occupying a sealing position in said tubular body when said lower radially movable means are moved inwardly to engage said cylindrical body adjacent said bottom surface and said upper radially movable means are moved inwardly to engage said force receiving ring after the latter has compressed said resilient sealing means;

c. a gate valve that includes an elongate valve body that when vertically disposed has upper and lower ends; a transversely movable valve member supported in said valve body, and said valve body having a longitudinal interior passage of at least as great transverse cross section as that of the interior of said tubular body; second means for connecting said lower end of said valve body to said upper end of said tubular body, said transverse valve member capable of occupying either an open or closed position, d. a hydraulic cylinder assembly that includes a hydraulic cylinder that has a top and bottom; a piston slidably mounted in said cylinder; third means for discharging hydraulic fluid under pressure into and out of said cylinder to move said piston upwardly and downwardly therein; fourth means for removably securing said bottom of said hydraulic cylinder to said upper end of said gate valve; a graduated rod that extends upwardly through a seal defining opening in said top of said hydraulic cylinder to visually indicate the longitudinal position of said plug assembly in said tubular body; an actuating member that extends downwardly from said piston through a seal defining opening in said bottom of said hydraulic cylinder and downwardly through said gate valve body when said valve member is in an outwardly disposed position; a transverse pin on a lower portion of said actuating member, which pin has projecting end portions; and a force exerting member supported from said actuating member above said pin, said lower portion of said actuating member disposed in said cavity and said projecting pin portions slidably disposed in said pair of vertical grooves; and e. fifth means for rotating said graduated rod, piston and actuating member to dispose said projecting pin portions in said horizontal groove, with said plug now being movable longitudinally in said tubular body for said teeth to scrape said foreign material therefrom when said upper and lower radially movable means are moved outwardly from engagement with said plug assembly, said plug assembly being returnable to a sealing position in said tubular body by raising said plug assembly upwardly above said lower radially movable means, moving said lower radially movable means inwardly, moving said plug assembly downwardly for said plug assembly to engage said lower radially movable means, rotating said graduated rod, piston and actuating member to dispose said projecting pin portions in said vertical grooves, moving said actuating member downwardly by said third means for said force exerting member to contact said force receiving ring to compress said resilient sealing means into sealing contact with the interior surface of said tubular member and dispose said force receiving ring below said upper radially movable means, moving said upper radially movable means inwardly to engage said force receiving ring; and said plug assembly, actuator member, hydraulic cylinder assembly capable of being removed from said tubular body by moving said actuator longitudinally and rotatably for said projecting pin portions to engage said horizontal grooves, said upper radially movable means being moved outwardly out of engagement with said force receiving ring, said plug assembly being moved upwardly in said gate valve body above said transversely movable gate valve member, said gate valve member being moved to an inwardly disposed closed position, whereupon said plug assembly, actuator member, hydraulic cylinder assembly and graduated rod may be removed from said gate valve for repair without shutting down said geothermal well.

3. A device as defined in claim 2 in which said lower and upper radially movable means are a plurality of upper and lower circumferentially spaced pins that have inner and outer ends, external threads intermediately disposed between said inner and outer ends, with said external threads engaging tapped transverse bores in said tubular body, and said outer ends of non-circular transverse cross section to permit said pins to be rotated by conventional wrench means.

4. A device as defined in claim 2 in which the portion of said actuator member in said cavity loosely engages the same, and said device in addition including:

f. resilient means in said cavity that at all times tend to move said actuating member upwardly therein to a position where said projecting pin portions are above said horizontal grooves.

5. A device as defined in claim 4 which in addition includes:

f. normally closed spring loaded valve means on said plug assembly which when the latter is in said sealing position may be moved by said actuator member to establish communication above and below said plug assembly when said projecting pin portions are moved in said vertical grooves to positions adjacent said lower ends thereof, said communication equalizing the pressure above and below said plug assembly prior to the latter being moved upwardly above said transversely movable gate valve member prior to said plug assembly, actuator member, hydraulic cylinder assembly and graduated rod being removed from said gate valve body.

6. A device as defined in claim 3 which in addition includes:

f. sixth means that allow longitudinal movement only of said force receiving ring relative to said cylindrical body, with said cylindrical body having a plurality of circumferentially spaced slots extending upwardly from said bottom surface thereof and said force receiving ring having a plurality of circumferentially spaced grooves in said upper surface thereof, said body and force receiving ring being rotatable by said actuating member to a first position where said slots and grooves are radially aligned with said upper and lower pins and be removably engaged thereby; and g. first and second insignia means on said graduated rod and top of said hydraulic cylinder that when disposed in a predetermined relationship relative to one another visually indicate that said force receiving ring and said cylindrical body are in said first position.

7. In combination with a tubular vertical member that is in communication with a casing of a geothermal well that extends downwardly to a producing zone, said tubular member having a plurality of lower circumferentially spaced tapped transverse bores therein and a plurality of upper circumferentially spaced tapped transverse bores therein, a device for scraping solid material from the interior of said tubular member when moved downwardly and sealing the interior of said tubular member when disposed between said upper and lower plurality of circumferentially spaced tapped bores:

a. a plurality of upper and lower elongate pins that have inner and outer ends and external threads intermediate therebetween, said pins engaging said upper and lower tapped bores, said outer ends being of non-circular transverse cross section to permit said pins to be rotated with a conventional tool;

b. a plug assembly that includes a rigid body having a top surface, a bottom surface and a generally cylindrical exterior surface extending therebetween, a ring shaped recess that extends downwardly in said cylindrical surface from said top surface to terminate in a circular body shoulder; a plurality of circular teeth defined on said cylindrical surface below said body shoulder; a cylindrical cavity that extends downwardly from said top surface to terminate in a bottom, said cavity having a pair of oppositely disposed grooves in communication therewith; a pair of horizontal grooves in communication with said cavity and with said vertical grooves at intermediate positions thereon; resilient packing means in said cylindrical cavity that slidably engage the interior surface of said tubular member; a plurality of circumferentially spaced slots in said cylindrical sidewall that have upper ends and are radially alignable with said lower pins; a rigid force receiving ring that has a vertical leg that rests on said resilient packing means and a horizontal leg that extends inwardly from said vertical leg, said force receiving ring having a plurality of transverse grooves defined therein that are radially aligned with said upper pins when said slots are aligned with said lower pins; a key that slidably connects said force receiving ring to said rigid body; a plate supported for vertical movement in said cavity; a first helical spring in said cavity that has one end resting on said bottom and the opposite end urging said plate upwardly;

c. an elongate vertical actuator member that includes a lower flat end; a transverse pin supported by said actuator member, said pin having projecting end portions, said actuator member loosely engaging said cavity with said projecting end portions slidably movable in said vertical grooves, said plate and first helical spring tending to maintain said actuator member where said projecting pin portions are above said horizontal grooves; and a force exerting member on said actuator member that may contact said force receiving ring, said plug assembly capable of being placed in a sealing position by disposing said projecting pin portions in said horizontal grooves, moving said plug assembly upwardly above said lower tapped bores, rotate said lower pins to move inwardly; lower said plug assembly with said actuator member for said upper ends of said slots to engage said inner ends of said lower pins; rotate said actuator rod to move said transverse pin portions into said pair of vertical grooves; move said actuator member downwardly for said force exerting ring to exert a downward force on said force receiving ring to radially expand said resilient means into sealing contact with the interior surface of said tubular member and said grooves slightly below said upper pins; rotate said upper pins to move inwardly for said inner ends to engage said grooves; and said plug assembly capable of being moved downwardly to scrape said foreign material from the interior of said tubular member by moving said upper pins outwardly, moving said actuator member upwardly and rotating the same to dispose said transverse pin portions in said horizontal grooves; moving said lower pins outwardly from engagement with said plug assembly; and moving said plug assembly downwardly by said actuator member for said teeth to scrape said foreign material from said tubular member.

8. A device as defined in claim 7 which in addition includes:

d. a valve seat defined in said bottom surface that communicates with a bore that extends upwardly to said cavity;

e. a valve member that may sealingly engage said seat;

f. a stem that extends upwardly from said valve member through said bore into said cavity, said stem having an enlarged upper end;

g. a second compressed helical spring that encircles said stem and has the ends thereof in abutting contact with said bottom of said cavity and said enlarged end portion to at all times tend to maintain said valve member in sealing engagement with said seat;

h. a bolt that extends through a centered opening in said plate and engages a tapped bore in said lower end of said actuator member to rotatably support said plate from said actuator member, said bolt having a tapped recess therein;

i. an elongate member that has a threaded portion that engages said tapped recess, with said elongate member extending downwardly therefrom, said elongate member when said actuating member is moved downwardly in said cavity to a position where said projecting pin portions are adjacent the lower ends of said vertical grooves contacting said stem to move said valve member downwardly out of engagement with said valve seat for pressurized fluid to flow upwardly through said valve seat, bore, cavity, around said plate and upwardly between said actuating member and cavity to equalize the pressure of said geothermal fluid above and below said plug assembly.

* * * * *